United States Patent [19]

Diamond

[11] Patent Number: 4,617,566

[45] Date of Patent: Oct. 14, 1986

[54] ADDRESSABLE-PORT, DAISY CHAIN TELEMETRY SYSTEM WITH SELF-TEST CAPABILITY

[75] Inventor: Anthony E. Diamond, San Diego, Calif.

[73] Assignee: Teleplex Corporation, San Diego, Calif.

[21] Appl. No.: 622,984

[22] Filed: Jun. 21, 1984

Related U.S. Application Data

[63] Continuation-in-part of Ser. No. 561,567, Dec. 15, 1983.

[51] Int. Cl.[4] ..... G08C 15/00

[52] U.S. Cl. ..... 340/870.11; 340/825.05; 340/825.16

[58] Field of Search ..... 375/3; 340/870.11, 825.05, 340/825.5, 825.16; 370/92

[56] References Cited

U.S. PATENT DOCUMENTS 4,413,259 11/1983 Lutz et al. ..... 340/870.11 X 4,528,662 7/1985 Floyd et al. ..... 340/825.05 X

*Primary Examiner*—Jerry W. Myracle

*Attorney, Agent, or Firm*—Edward W. Callan

[57] ABSTRACT

A telemetry system for transferring blocks of pulsed data signals to and from daisy chains of addressable data ports. The telemetry system includes a daisy chain of input data ports and a parallel daisy chain of output data ports; an output data line and an input data line each serially-connecting the data ports; a clock signal generator for generating square wave clock pulses for common system timing; and a clock line for carrying the clock pulses to the ports. Each data port contains an address circuit which determines when during each block of serially-transmitted data signals that port is enabled to transfer data independent of its physical location on the data line. Data signals are transmitted over the data lines during high-state intervals of the clock signal and control signals such as frame signals, are transmitted over the data lines during the low-state intervals of the clock signals. The data ports demultiplex received data/control signals received over the data line for data transfer operations and internal control, regenerate the received signals for further transmission to distant data ports in the chain, and multiplex the regenerated data and control signals onto the data line for such further transmission. The system is also capable of determining the serial location of a data port where a failure has occurred.

16 Claims, 7 Drawing Figures

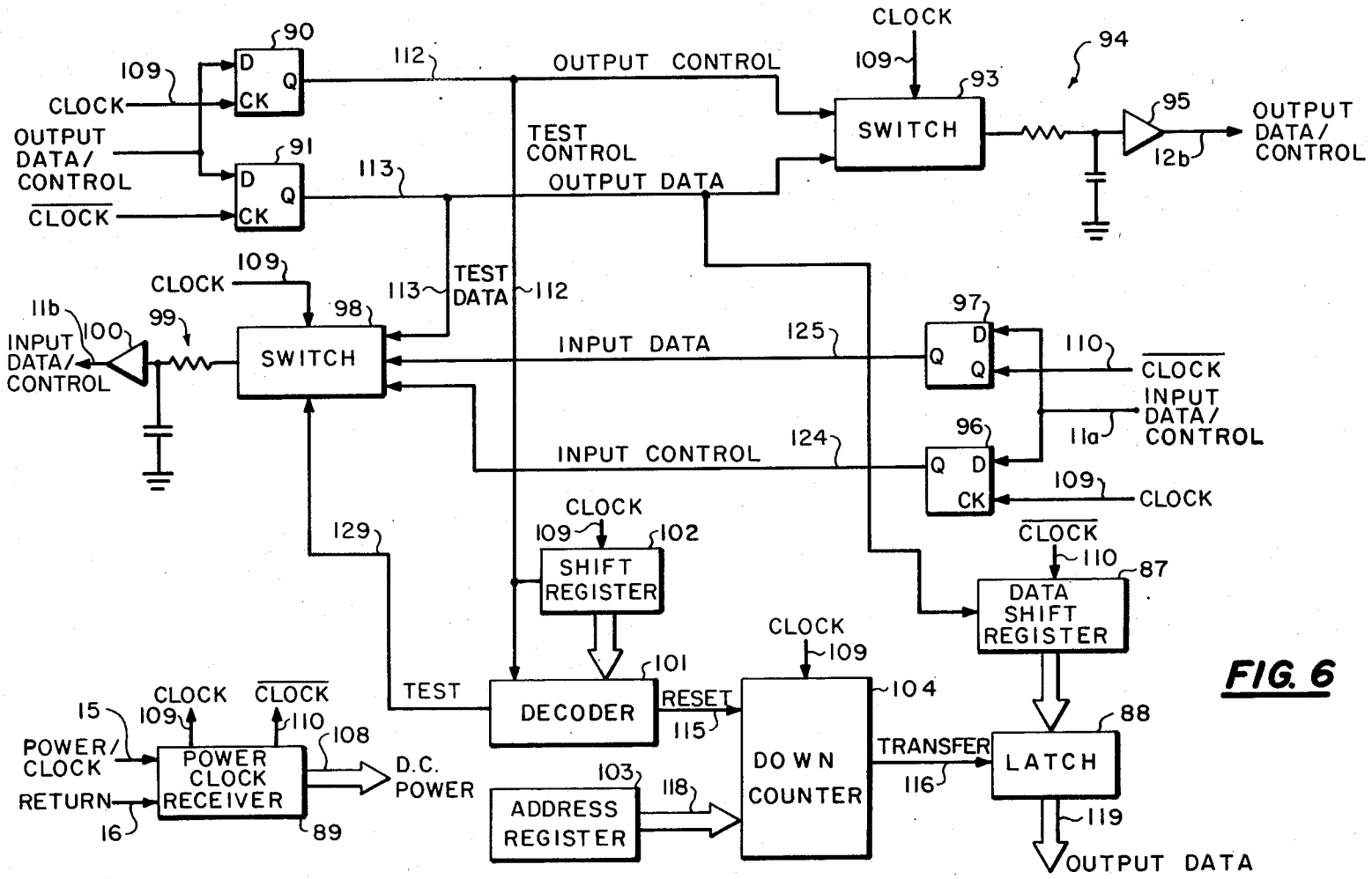
OUTPUT DATA/ CONTROL
95
12b
94
CLOCK
109
SWITCH
93
OUTPUT CONTROL
TEST CONTROL
OUTPUT DATA
112
113
90
91
D
Q
CK
CLOCK
OUTPUT DATA/ CONTROL
CLOCK
TEST DATA
INPUT DATA
INPUT CONTROL
125
124
97
96
110
11a
CLOCK
INPUT DATA/ CONTROL
CLOCK
98
SWITCH
99
100
11b
INPUT DATA/ CONTROL
87
DATA SHIFT REGISTER
88
LATCH
119
OUTPUT DATA
TRANSFER
116
104
DOWN COUNTER
RESET
115
118
ADDRESS REGISTER
103
102
SHIFT REGISTER
101
DECODER
TEST
129
D.C. POWER
108
89
POWER CLOCK RECEIVER
15
16
POWER/ CLOCK
RETURN
FIG. 6

ADDRESSABLE-PORT, DAISY CHAIN TELEMETRY SYSTEM WITH SELF-TEST CAPABILITY

CROSS REFERENCE TO RELATED APPLICATION

This is a continuation-in-part of Application Ser. No. 561,567 filed Dec. 15, 1983, entitled "Addressable Port Telemetry System".

BACKGROUND OF THE INVENTION

This invention relates in general to telemetry systems and is more particularly directed to systems with a daisy chain of data ports. A daisy chain of data ports is a chain of serially-connected data ports, wherein a signal is passed from port to the next in serial fashion.

Among other uses, telemetry systems commonly are used to transfer data from a plurality of equipment monitors and to transfer data to a plurality of equipment controls. Telemetry systems for tranferring data from and to transmitters and receivers to and from a plurality of equipment controls and monitors are made in many configurations for various specific uses. Among the parameters determining which telemetry system configuration is utilized are access time, simplicity of use and cost. Because the cost of transmission lines can be considerable, particularly where long distances between the transmitter or receiver and the equipment controls or monitors are involved, daisy-chain systems utilizing only one output data line and/or one input data line are desirable. Such a system is described in U.S. Patent Application Ser. No. 428,545 by Herbert Alan Schwan filed Sept. 30, 1982 for "TELEMETRY SYSTEM FOR DISTRIBUTED EQUIPMENT CONTROLS AND EQUIPMENT MONITORS". In such system, data ports coupled to the controls and monitors are attached to the respective output or input data line serially as shift register stages. The output data from the transmitter is shifted down the output data line with each shift being clocked by a clock pulse, until the data reaches the shift register stage (data ports) for the last equipment control. At that time a clock frame pulse simultaneously enables all of the shift register stages (data ports) to transfer their instant data to their respective equipment controls. Input data is shifted up the input data line to the receiver in the same manner from data ports that are coupled to the equipment monitors and which are connected to each other in series to function as stages of a shift register.

SUMMARY OF THE INVENTION

The present invention provides an improved telemetry system for transferring pulsed input data signals in series from a daisy chain of input data ports to a receiver. The system includes a daisy chain of input data ports; a clock signal generator for generating a pulsed clock signal having periodically alternating first and second states; a clock line serially connected to the input data ports for carrying the clock signal pulses from the clock signal generator to the input data ports for timing the operation of the data ports; a control signal generator for generting control signal pulses during the first state intervals of the pulsed clock signal; and an input data line serially-connecting the input data ports to the control signal generator and to said receiver for carrying the control signal pulses from the control signal generator to the data ports and a serial block of data pulses from the respective input data ports to the receiver. Each input data port includes a data register for registering an input data signal related to that input data port and for serially transferring the input data signal pulses related to that input data port from the data register onto the input data line during the second-state intervals of the pulsed clock signal, a circuit for demultiplexing data signal pulses and control signal pulses received over the input data line from other input data ports and the control signal generator, and apparatus for multiplexing all of the input data signal pulses and control signal pulses onto the input data line in their respective clock signal state intervals for transmission to the receiver and other input data ports connected in series between that input data port and the receiver.

In accordance with one aspect of the present invention each input data port further includes an address circuit for determining when that port is enabled to transfer input data signals related to that port onto the input data line independent of that port's physical location on the input data line. As a result the telemetry system can be modified easily. In a preferred embodiment in which the control signals generated by the control signal generator includes frame signals for indicating each beginning of a block of data pulses from the daisy chain of input data ports, the address circuit includes a frame signal detector connected to the data line for providing a reset signal to a clock pulse counter in response to each frame signal; an address register for storing a preselected count that determines when the port is enabled to transfer data onto the input data line; and a clock pulse counter for counting clock pulses beginning with each reset signal and coupled to the address register for providing a transfer signal when said clock pulse count equals the stored preselected count. The data register is coupled to the clock pulse counter for transferring the input data signal related to that input data port onto the input data line when the transfer signal is provided by the clock pulse counter to thereby merge the related input data signal with input data signals transferred onto the input data line from the other input data ports.

The present invention also provides an improved telemetry system for transferring pulsed output signals in series to a daisy chain of output data ports from a transmitter. Such system is generally the same as the above-described improved telemetry system for transferring pulsed input signals from a daisy chain of input data ports to a receiver. Output data lines replace the input data lines and each output data port includes a data register for registering output data signals and for serially-transferring the output data signal pulses into the data register from the output data lines during the second-state intervals of the pulsed clock signal; a circuit for demultiplexing data signal pulses and control signal pulses received over the output data line from other output data ports, said transmitter and the control signal generator; and apparatus for multiplexing all of the output data signal pulses and control signal pulses onto the output data line in their respective clock signal-state intervals for transmission to the other output data ports connected in series beyond that output data port with respect to the transmitter.

In accordance with another aspect of the present invention, an input/output daisy chain telemetry system includes a subsystem for determining the serial location of a data port where a failure has occurred.

In such telemetry system, the input data line and the output data line each serially connect the input data ports and the output data ports; and the subsystem for determining the location of a failure includes a circuit for generating a predetermined test control signal during first-state intervals of the clock signal and for generating predetermined test data signals during immediately following second-state intervals of the clock signal. The transmitter is coupled to the test signal generator for transmitting the test control and test data signals over the output data line. This subsystem further includes a circuit in each data port for recognizing the test control signal and for responding to such recognition by transferring the immediately following test data signal from the output data line onto the input data line in substitution for the input data signal, whereby said test data signal is carried to the receiver; a comparator for comparing the data signal received by the receiver over the input data line with the test data signal; and a counter for counting clock signal pulses beginning upon the transmission of the test data signal and continuing until a data signal is received over the input line that is different than the test data signal that was transmitted over the output line to thereby obtain of count indicating the number of data ports removed from the transmitter at which a data port failed to accurately return the test data signal that was transmitted.

Additional features of the present invention are described in relation to the description of the preferred embodiments.

BRIEF DESCRIPTION OF THE DRAWING

FIG. 6 is a combination block and schematic diagram of a preferred embodiment of an output data port in the system of FIG. 1.

DESCRIPTION OF THE PREFERRED EMBODIMENT

Figure 1:
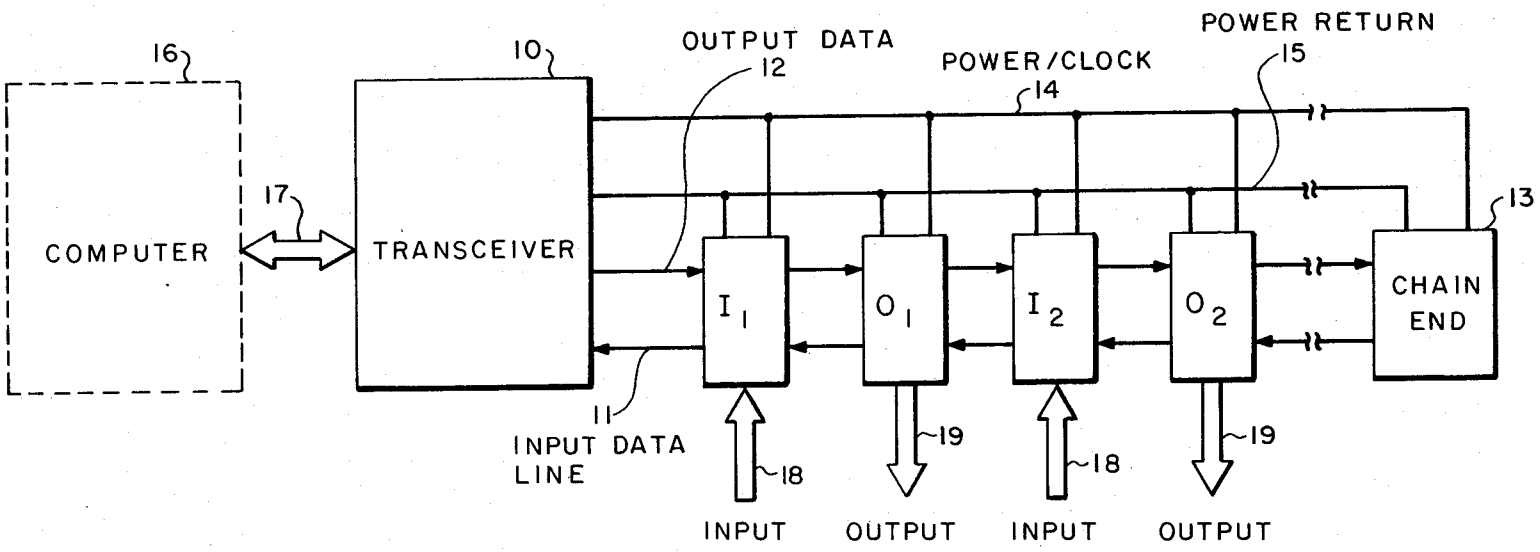
FIG. 1 is a block diagram of a preferred embodiment of an input/output, daisy chain telemetry system according to the present invention.

Referring to FIG. 1, the preferred embodiment of an input/output, daisy chain telemetry system according to the present invention includes a transceiver unit 10, a daisy chain of input data ports $I_1$, $I_2$, . . . serially connected by an input data line 11, a daisy chain of output data ports $O_1$, $O_2$, . . . serially connected by an output data line 12, a chain end module 13, a power/clock line 14, and a power return line 15. The chain end module 13 is connected at the end of the parallel series chains of the input data ports $I_1$, $I_2$, . . . and the output data ports $O_1$, $O_2$, . . . . The power/clock line 14 is connected from the transceiver unit 10 to each data port $I_1$, $I_2$, . . . , $O_1$, $O_2$, . . . and the chain end module 13 for carrying a combined power and clock signal from the transceiver unit 10 to these data ports and the chain end module 13. The power return line 15 is also connected between to chain end module 13, the data ports $I_1$, $I_2$, . . . , $O_1$, $O_2$, . . . , and the transceiver unit 10.

The input data ports $I_1$, $I_2$, . . . , receive input data signals from equipment sensing systems (not shown); via lines 18 and the output data ports $O_1$, $O_2$, . . . provide output data signals to equipment controllers (not shown) via lines 19. The transceiver unit 10 is interfaced with a computer 16 via lines 17.

Figure 2:
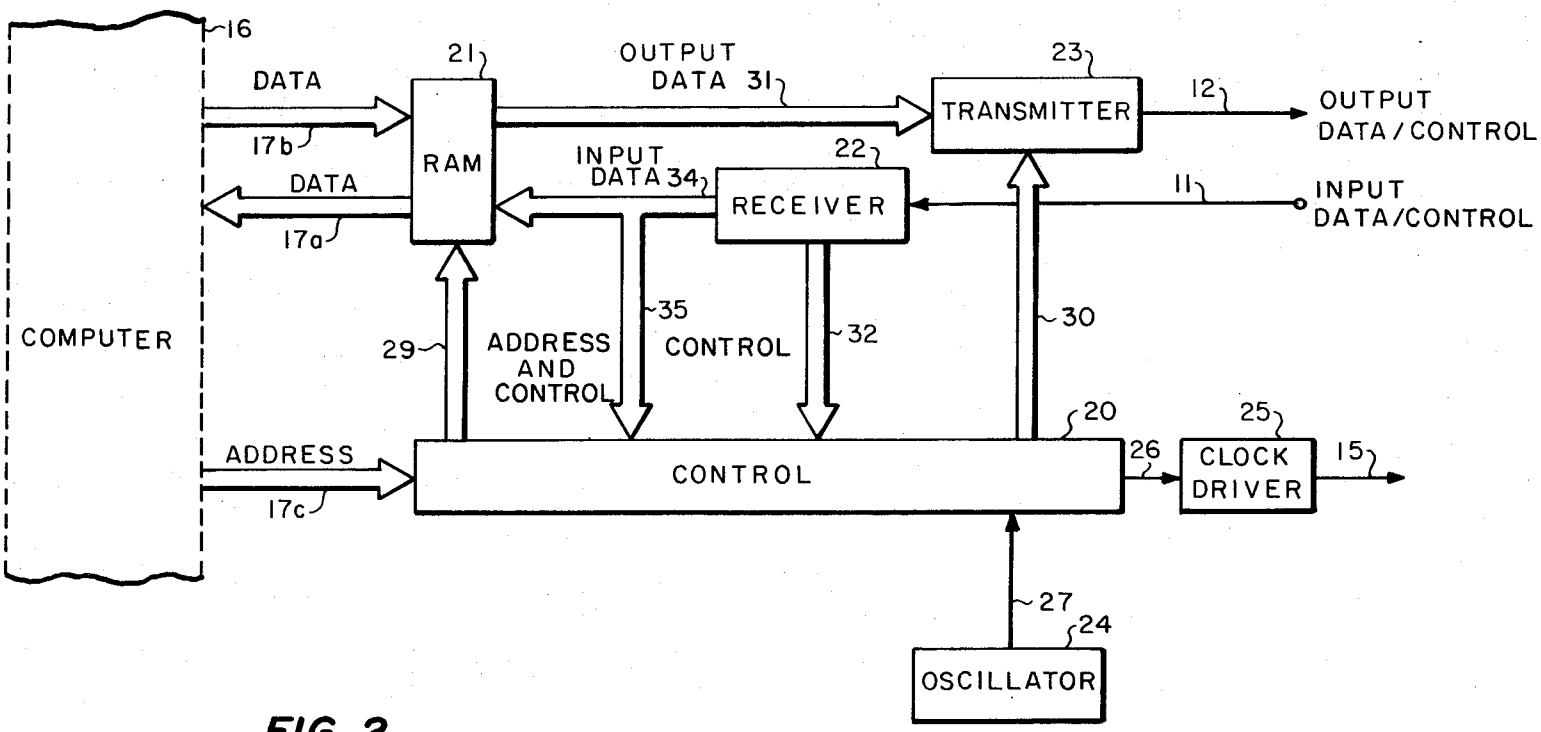
FIG. 2 is a block diagram of a preferred embodiment of the transceiver in the system of FIG. 1.

Referring to FIG. 2, the transceiver unit 10 (shown in FIG. 1) includes a control system 20, a data random access memory (RAM) 21, a receiver circuit 22, a transmitter circuit 23, an oscillator circuit 24 and a clock driver circuit 25. The control system 20 generates a square wave pulsed clock signal on line 26 in response to a timing signal on line 27 from the oscillator circuit 24. The clock driver circuit 25 drives the clock signal from line 26 with DC power to provide a pulsed power/clock signal on line 15 to the data ports and chain end module shown in FIG. 1.

Input and output data signals are transferred via lines 17*a* and 17*b* respectively between the data RAM 21 and the computer 16. Address signals are provided from the computer 16 to the control system 20 via lines 17*c*. The control system 20 responds to the address signals on lines 17*c* by providing address and control signals on lines 29 for accessing appropriate storage locations in the RAM 21 for storage or retrieval of data signals.

The control system 20 generates pulsed control signals on lines 30 for controlling the operation of the output data ports $O_1$, $O_2$, . . . .

The transmitter circuit 23 multiplexes the pulsed control signals on lines 30 from the control system 20 with pulsed output data signals on lines 31 from the RAM 21 and transmits the multiplexed output data/control signals over the output data line 12 to the output data ports $O_1$, $O_2$, . . . .

The receiver circuit 22 receives multiplexed input data/control signals over the input data line 11 from the input data ports $I_1$, $I_2$, . . . . The receiver demultiplexes the input data/control signals received over line 11 and provides the control signals to the control system 20 via lines 32 and the input data signals to the RAM 21 via lines 34 and to the control system 20 via lines 35. The control signals that are received over the input data line 11 are generated by the chain end module 13. (FIG. 1).

Figure 3:
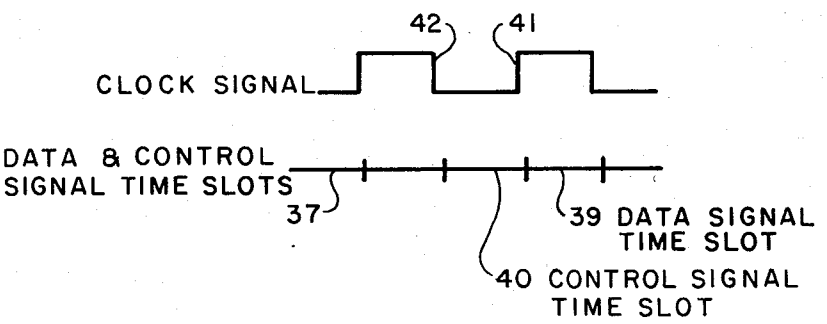
FIG. 3 illustrates the respective time slots of the control signal and the data signals in relation to the clock signal.

The multiplexing of the data and control signals onto a single data line is explained with reference to FIGS. 3 and 4. The clock signal 36 is a fifty percent duty cycle square wave pulsed signal having alternating high and low states as shown in both FIGS. 3 and 4. Waveform 37 in FIG. 3 illustrates the respective time slots on the data line of the data signal and the control signal. The control system 20 and the chain edge module 13 generate control signal pulses during the low-state intervals of the pulsed clock signal on line 15; and the data signal pulses are entered onto the data line during the high-state intervals of the pulsed clock signal on line 15.

The data and control signal time slots, 39 and 40 respectively, are slightly delayed from the clock transitions 41 and 42 respectively so that the data and control signals will not change until after the clock transitions. The data signals are entered during the high-state intervals so that they can be shifted on the falling edges 42 of the clock pulses.

Figure 4:
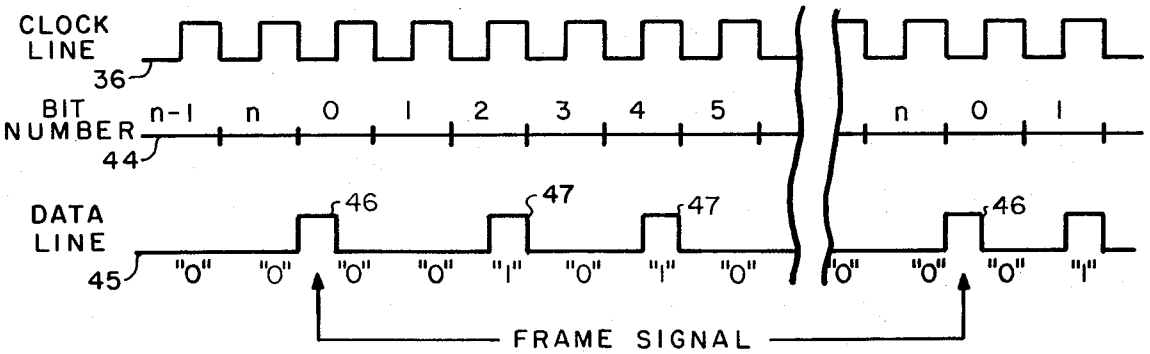
FIG. 4 illustrates the identification of control signal pulses and data signal pulses in relation to the clock signal.

Referring to FIG. 4, waveform 44 identifies the bit positions n−1, n, 0, 1, 2, . . . in the data/control signal on the data line. During each bit position, the control signal time slot precedes the data signal pulse time slot.

Waveform 45 illustrates an example of a data/control interval of the clock signal which corresponds to the control signal time slot, to indicate the start of each serial block of data signals to or from a chain of data ports, and thereby nominally indicates bit position "0". A "1" data bit is indicated by a data signal pulse 47 during high state intervals of the clock signal which corresponds to the data signal time slots; and a "0" data bit is indicated when there is no data signal pulse during the high-state interval of the clock signal.

The frame signals that are transmitted to the output data ports $O_1$, $O_2$, . . . over the output data line 12 are generated by the control system 20 of the transceiver unit 10; and the frame signals that are carried over the input data line 11 to the input data ports $I_1$, $I_2$, . . . and the signal receiver 22 are generated by the chain end module 13. The chain end module 13 can be programmed to generate a frame signal pulse in response to various signal sources, such as a frame signal pulse received over the data output line 12, an independent command line (not shown) or a timer (not shown) within the chain end module 13.

The chain end module does not generate any high-state pulses during the high-state intervals of the power/clock signal and thereby provides a stream on "0" data bits on the input data line 11 to the chain input data ports $I_1$, $I_2$, . . . .

Figure 5:
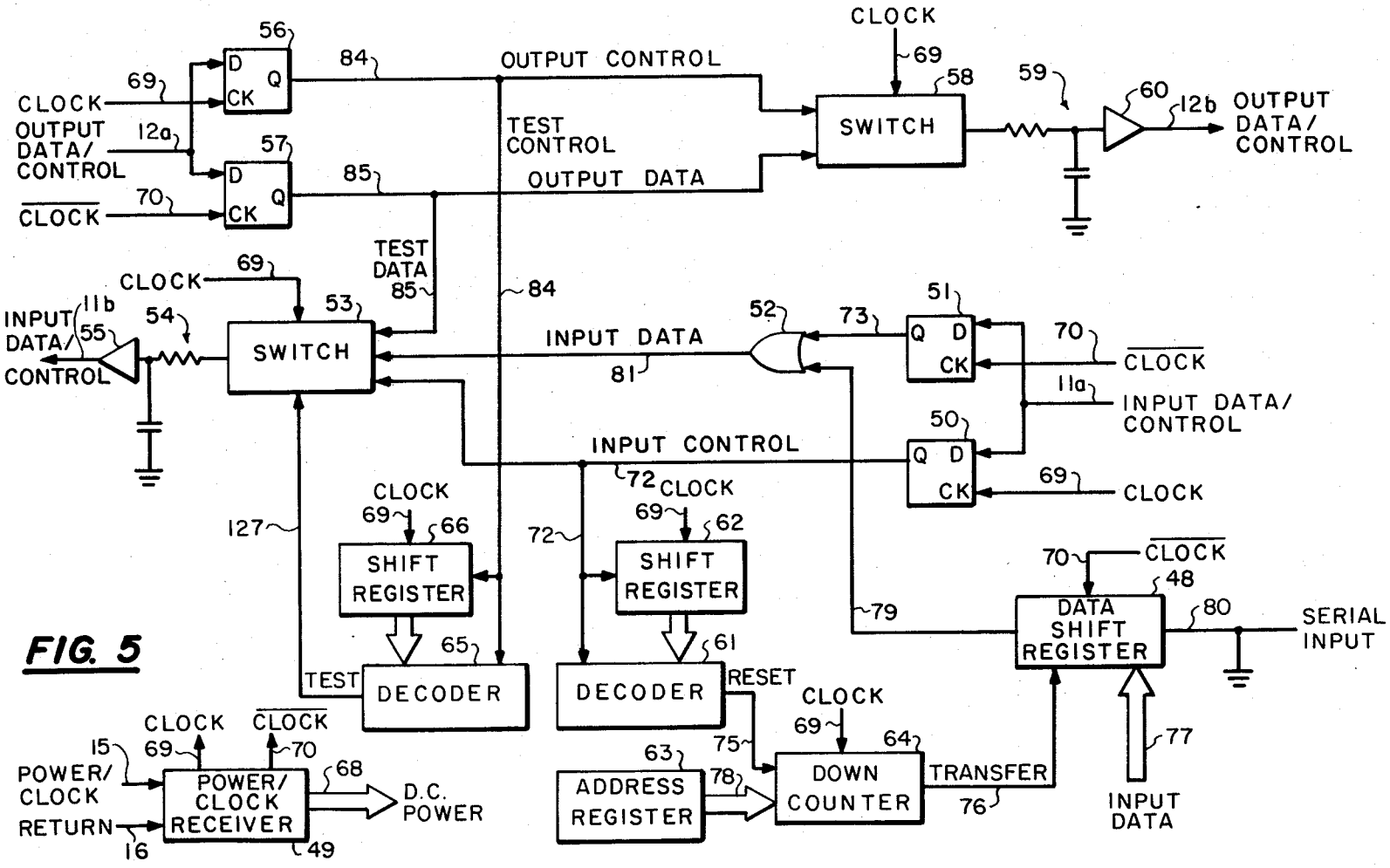
FIG. 5 is a combination block and schematic diagram of a preferred embodiment of an input data port in the system of FIG. 1.

Referring to FIG. 5, each input data port includes an input line circuit, an output line circuit, an address circuit, a test recognition circuit, a data register 48 and a power/clock signal receiver circuit 49.

The input line circuit includes a first pair of flip-flops 50, 51, an OR gate 52, a first switch 53, a first RC delay circuit 54 and a first amplifier 55. The output line circuit includes a second pair of flip-flops 56, 57, a second switch 58, a second RC delay circuit 59 and a second amplifier 60. The address circuit includes a first decoder 61, a second shift register 62, an address register 63 and a down counter 64. The test recognition circuit includes a second decoder 65 and a third shift register 66, and is further discussed below with reference to FIG. 7.

The operation of the input data port is timed by the power/clock receiver circuit 49 in response to the power/clock signal received on power/clock line 15. The power/clock receiver circuit 49 processes the power/clock signal received on line 15 to provide a DC power signal on line 68, CLOCK pulses on line 69 which are high during the high-state intervals of the power/clock signal on line 15 and $\overline{\text{CLOCK}}$ pulses on line 70 which are high during the low-state intervals of the power/clock signal on line 15.

In the input circuit, the two flip-flops 50, 51 are connected to the entering input data line 1*a* to demultiplex the input data/control signal received on the entering input data line 11*a*. The entering input data line 11*a* is connected to the data input D of each of the flip-flops 50, 51. One flip-flop 50 is clocked by the rising edge of the CLOCK pulses on line 69 to regenerate the control signal received from the entering input data line 11 onto an internal control line 72; and the other flip-flop 51 is clocked by the rising edge of the $\overline{\text{CLOCK}}$ pulses on line 70 to regenerate the input data signal received from the input data line 11*a* onto an internal data line 73. By regenerating the data/control signals the time relationship between the data/control signal pulses and the clock signal pulses is maintained so that the data ports $I_1$, $I_2$, . . . $O_1$, $O_2$, . . . may be located further apart. The distance between such ports is limited by the travel time of the data signal pulses over such distance. In a system operating at a clock pulse rate of 100 KHPV2PV, the distance between ports is limited to approximately 2000 feet. If the data/control signal pulses were not regenerated at each data port, the length of the chain would be limited to such distance.

The control signal is clocked into the one flip-flop 50 on the rising edge of the CLOCK pulses on line 69; and the input data signal is clocked into the other flipi-flop 51 on the rising edge of the $\overline{\text{CLOCK}}$ pulses on line 70. Each flip-flop 50, 51 stores the respective control or data signal for one full clock period on the respective internal control or data line 72, 73.

The received input control signal on line 72 is provided to the decoder 61 and the shift register 62 of the address circuit. The bits of the control signal are shifted through the shift register 62 which is clocked by the CLOCK pulses on line 69. the decoder 61 examines the control signal bit on line 72 and the bits then present in the shift register 62 to determine when the control signal bit on line 72 is a frame signal. Upon recognizing a frame signal on line 72, the decoder 61 provides a RESET signal on line 75 to the down counter 64. The down counter 64 is reset by the RESET signal on line 75 to a preselected initial count, which is stored in the address register 63 and provided to the down counter 64 via lines 78. The preselected count is stored in the address register 63 by the operation of switches (not shown) connected to the address register 63. The selectable address allows systems to be modified easily since a data port's address is independent of its position in the daisy chain. The selectable address also allows ease in programming the computer 16 since data port addresses can be set to correspond with RAM word boundaries.

The down counter 64 counts the CLOCK pulses provided thereto on line 69 until a zero count is reached; whereupon the down counter 64 provides a TRANSFER signal on line 76 to the data shift register 48. The data shift register 48 responds to the TRANSFER signal on line 76 by registering the input data signal related to the data port from lines 77. The related input data signal is registered in parallel from lines 77 and is transferred serially from the data shift register 48 onto line 79. The serial transfer of data from the data shift register 48 is clocked by the $\overline{\text{CLOCK}}$ pulses on line 70. The serial input 80 to the data shift register is grounded so as to provide a flow of "0" data bits from the data shift register 48 between those times when the related input data signal is registered in and transferred from the data shift register 48.

The related input data signal on line 79 is merged by the OR gae 52 onto an internal input data line 81 with the input data signals transferred onto the input data line 11 from the input data ports that are between that data port and the chain end module 13.

The switch 53 in the input line circuit multiplexes the input data signal pulses from line 81 and the control signal pulses from line 72 onto the exiting input data line 11*b*. The switch 53 is operated in response to the CLOCK pulse signal on line 69 to provide the data signal pulses on line 11*b* during the high-state intervals of the power clock signal on line 15 and to provide the control signal pulses on line 11 during the low-state intervals of the power/clock signal on line 15.

The multiplexed input/data control signal provided on the exiting input data line 1b by the switch 53 is slightly delayed by the RC delay circuit 54 and amplified by the amplifier 55 for transmission to the receiver circuit 22 in the transceiver unit 20 and to the input ports connected in series between that input port and the receiver circuit 22. The input data/control signals on exiting line 11b are slightly delayed so that the data and control signals will not change until after the power/clock signal transitions.

Referring now to the output line circuit, the two flip-flops 56, 57 are connected to the entering output data line 12a to demultiplex the output data/control signal received on the entering output data line 12a. The entering output data line 12a is connected to the data input D of each of the two flip-flops 56, 57. One flip-flop 56 is clocked by the rising edge of the CLOCK pulses on line 69 to regenerate the control signal received from the entering output data line 12a onto an internal control line 84; and the other flip-flop 57 is clocked by the rising edge of the $\overline{\text{CLOCK}}$ pulses on line 70 to regenerate the output data signal received from the entering output data line 12a onto an internal data line 85. The control signal is clocked into the one flip-flop 56 on the rising edge of the CLOCK pulses on line 69; and the output data signal is clocked into the other flip-flop 57 on the rising edge of the $\overline{\text{CLOCK}}$ pulses on line 70. Each flip-flop stores the respective control signal for one full clock period on the respective internal control or data line 84, 85.

The switch 58 in the output line circuit multiplexes the output data signal pulses from line 85 and the control signal pulses from line 84 onto the existing output data line 12b. The switch 58 is operated in response to the CLOCK pulse signal on line 69 to provide the data signal pulses on line 12b during the high-state intervals of the power/clock signal on line 15 and to provide the control signal pulses on line 12b during the low-state intervals of the power/clock signal on line 15.

The multiplexed output/data control signal provided on the existing output data line 12b by the switch 58 is slightly delayed by the RC delay circuit 59 and amplified by the amplifier 60 for transmission to the output ports connected in series between that output port and the chain end module 13. The output data/control signals on exiting line 12b are slightly delayed so that the data and control signals will not change until after the power/clock signal transitions.

Referring to FIG. 6, each output data port includes an output line circuit, an input line circuit, an address circuit, a test recognition circuit, a data register 87, a latch 88 and a power/clock signal receiver circuit 89. The output line circuit includes a first pair of flip-flops 90, 91, a first switch 93, a first RC delay circuit 94 and a first amplifier 95. The input line circuit includes a second pair of flip-flops 96, 97, a second switch 98, a second RC delay circuit 99 and a second amplifier 100. The address circuit includes a decoder 101, a second shift register 102, an address register 103 and a down counter 104.

The operation of the output data port is timed by the power/clock signal received by the power/clock receiver circuit 89 on power/clock line 15. The power/clock receiver circuit 89 processes the power/clock signal received on line 15 to provide a DC power signal on line 108, CLOCK pulses on line 109 which are high during the high-state intervals of the power/clock signal on line 15 and $\overline{\text{CLOCK}}$ pulses on line 110 which are high during the low-state intervals of the power/clock signal on line 15.

In the output line circuit; the two flip-flops 90, 91 are connected to the entering output data line 12a to demultiplex the output data/control signal received on the entering output data line 12a. The entering output data line 12a is connected to the data input D of each of the flip-flops 90, 91. One flip-flop 90 is clocked by the rising edge of the CLOCK pulses on line 109 to regenerate the control signal received from the entering output data line 12a onto an internal control line 112; and the other flip-flop 91 is clocked by the rising edge of the $\overline{\text{CLOCK}}$ pulses on line 110 to regenerate the output data signal received from the output data line 12a onto an internal data line 113.

The control signal is clocked into the one flip-flop 90 on the rising edge of the $\overline{\text{CLOCK}}$ pulses on line 109; and the output data signal is clocked into the other flip-flop 91 on the rising edge of the CLOCK pulses on line 110. Each flip-flop 90, 91 stores the respective control or data signal for one full clock period on the respective internal control or data line 112, 113.

The output data signal on line 113 is registered serially in the data register 87, which is clocked by the $\overline{\text{CLOCK}}$ pulses on line 110.

The received control signal on line 112 is provided to the decoder 101 and the shift register 102 of the address circuit. The bits of the control signal are shifted through the shift register 102 which is clocked by the CLOCK pulses on line 109. The decoder examines the control signal bit on line 112 and the bits then present in the shift register 102 to determine when the control signal bit on line 112 is a frame signal. Upon recognizing a frame signal on line 112, the decoder 101 provides a RESET signal on line 115 to the down counter 104. The down counter 104 is reset by the RESET signal on line 115 to a preselected initial count, which is stored in the address register 103 and provided to the down counter 104 via lines 118. The preselected count is stored in the address register 103 by the operation of switches (not shown) connected to the address register 103.

The down counter 104 counts the CLOCK pulses provided thereto on line 109 until a zero count is reached; whereupon the down counter 104 provides a TRANSFER signal on line 116 to the latch 88. The latch 88 responds to the TRANSFER signal on line 116 by tranferring the output data signal related to the data port from the data register 87. The related output data signal is transferred by the latch 87 in parallel onto lines 119 from the data register 87.

The related output data signal on lines 119 is segregated from the output data signals on the output data line 12 that relate to other output data ports that are between the transmitter circuit 23 and the chain end module 13.

The switch 93 in the output line circuit multiplexes the output data signal pulses from line 113 and the control signal pulses from line 112 onto the exiting output data line 12b. The switch 93 is operated in response to the CLOCK pulse signal on line 109 to provide the data signal pulses on line 12b during the high-state intervals of the power/clock signal on line 15 and to provide the control signal pulses on line 12b during the low-state intervals of the power/clock signal on line 15.

The multiplexed output/data control signal provided on the exiting output data line 12b by the switch 93 is slightly delayed by the RC delay circuit 94 and amplified by the amplifier 95 for transmission to the remaining output data ports connected in series between that output data port and the chain end module 13. The output data/control signals on exiting line 12*b* are slightly delayed so that the data and control signals will not change until after the power/clock signal transitions.

Referring now to the input line circuit, the two flip-flops 96, 97 are connected to the entering input data line 11*a* to demultiplex the input data/control signal received on the entering input data line 11*a*. The entering input data line 11*a* is connected to the data input D of each of the two flip-flops 96, 97. One flip-flop 96 is clocked by the rising edge of the CLOCK pulses on line 109 to regenerate the control signal received from the entering input data line 11*a* onto an internal control line 124; and the other flip-flop 97 is clocked by the rising edge of the $\overline{\text{CLOCK}}$ pulses on line 110 to regenerate the input data singal received from the entering input data line 11*a* onto an internal data line 125. The control signal is clocked into the one flip-flop 96 on the rising edge of the $\overline{\text{CLOCK}}$ pulses on line 109; and the input data signal is clocked into the other flip-flop 97 on the rising edge of the $\overline{\text{CLOCK}}$ pulses on line 110. Each flip-flop 96, 97 stores the respective control or data signal for one full clock period on the respective internal control or data line 124, 125.

The switch 98 in the input line circuit multiplexes the input data signal pulses from line 125 and the control signal pulses from line 124 onto the exiting input data line 11*b*. The switch 98 is operated in response to the CLOCK pulse signal on line 109 to provide the data signal pulses on line 11*b* during the high-state intervals of the power/clock signal on line 15 and to provide the control signal pulses on line 11*b* during the low-state intervals of the power/clock signal on line 15.

The multiplexed input data control signal provided on the exiting output data line 11*b* by the switch 98 is slightly delayed by the RC delay circuit 99 and amplified by the amplifier 100 for transmission to the receiver circuit 22 in the transceiver unit 20 and to the input data ports connected in series between that input data port and the receiver circuit 22. The output data/control signals on exiting line 11*b* are slightly delayed so that the data and control signals will not change until after the power/clock signal transitions.

Referring again to FIG. 2, the transceiver unit generates and transmits test control signals and test data signals in order to enable a determination of the location of any data port $I_1, I_2, \ldots, O_1, O_2, \ldots$ where a failure may have occured. The control system 20 generates the test control signal in response to a predetermined address on line 17*c* from the computer 16 and provides the test control signal on lines 30 to the transmitter circuit 23. The control system 20 further responds to the predetermined address on line 17*c* by providing address and control signals on lines 29 that will result in a test data signal being read out of the RAM 21 and provided on lines 31 to the transmitter circuit 23. The test control signal includes a combination of several bits that can be readily distinguished from the frame signal discussed above in reference to FIG. 4. The test data signal is a pair of "0" or "1" bits followed by a string of the complementary bits. The test control signal pulses are generated and transmitted on the output data line 12 during the low-state intervals of the clock signal on line 15; and the test data signal is generated and transmitted and generated on the output data line 12 during the high-state intervals of the clock signal on line 15 immediately following the transmission of the complete test control signal.

Each data port $I_1, I_2, \ldots O_1, O_2, \ldots$ recognizes the test control signal and responds to such recognition by transferring the immediately following test data signal from the output data line 12 onto the input data line 11 in substitution for the input data signal, whereby the test data signal is carried to the receiver circuit 22.

Referring to the input data port of FIG. 5, the test data signal is provided on line 85; and the test control signal is provided on line 84. The test control signal is clocked into the shift register 66 by the CLOCK pulses on line 69. The decoder 65 examines the contents of the shift register 66 and the bit of the control signal on line 84 to determine when the control signal provided on line 84 is a test control signal. Upon recognizing a test control signal on line 84, the decoder provides a TEST signal on line 127 to the switch 53. The switch 53 responds to the TEST signal on line 127 by substituting the test data signal on line 85 for the input data signal on line 81.

Referring to the output data port of FIG. 6, the test data signal is provided on line 113, and the test control signal is provided on line 112. The test control signal is clocked into the shift register 102 by the CLOCK pulses on line 109. The decoder 101 examines the contents of the shift register 102 and the bit of the control signal on line 112 to determine when the control signal provided on line 112 is a test control signal. Upon recognizing a test control signal on line 112, the decoder 101 provides a TEST signal on line 129 to the switch 98. The switch 98 responds to the TEST signal on line 129 by substituting the test data signal on line 113 for the input data signal on line 125.

Figure 7:
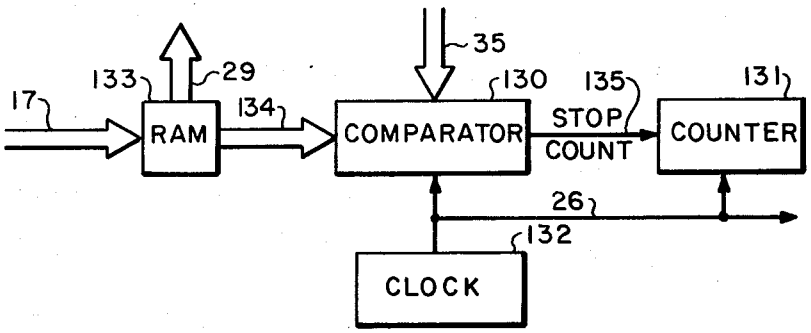
FIG. 7 is a block diagram of a subsystem included in the transceiver control system of FIG. 2 that is used for determining the serial location of a data port where a failure has occurred.

The control system 20 of the transceiver unit 10 processes the signals returned to the receiver circuit 22 to determine the locations of any data port where a failure may have occurred. Such failure would be indicated by a difference between the test data signal that is transmitted by the transmitter circuit 23 and the signal that is received by the receiver circuit 22 in the corresponding time slot. Accordingly, the control system 20 of the transceiver includes a comparator 130, a counter 131, a clock 132 and a RAM 133, as shown in FIG. 7. The RAM 133 in the control system 20 responds to the address signal on lines 17*c* from the computer 16 by providing on lines 134 to the comparator 130 the same data test signal that is provided to the transmitter circuit 23 on line 31 by the RAM 21 in response to the address that is provided on line 29 in response to the address signal on lines 17. For example when the RAM 21 provides a string of "1" bits as the test data signal on line 31, the RAM 133 provides a string of "1" bits on lines 134 to the comparator 130.

The clock 132 is the clock that generates the clock signal provided on line 26 to the clock driver 25. (FIG. 2). The counter 131 counts the clock pulses on line 26 beginning upon the transmission of the test data signal on the data output line 12.

The comparator 130 compares the data signal on lines 35 received by the receiver circuit 22 over the input data line 11 with the test data signal as provided on lines 134. When the received signal on lines 35 differs from the test data signal on lines 134 the comparator provides a STOP COUNT signal on line 135 to the counter 131. The counter 131 stops counting clock pulses when it receives a STOP COUNT signal on line 135 and thereby indicates the number of data ports removed from the transmitter circuit 23 at which a data port failed to accurately return the test data signal that was transmitted.

What is claimed is:

1. A telemetry system for transferring pulsed input data signals in series from a daisy chain of input data ports to a receiver, said system comprising a daisy chain of input data ports;

a clock signal generator for generating a pulsed clock signal having periodically alternating first and second states;

a clock line connected to the input data ports for carrying the clock signal pulses from the clock signal generator to the input data ports for timing the operation of the data ports;

a control signal generator for generating control signal pulses during the first-state intervals of the pulsed clock signal; and an input data line serially-connecting the input data ports to the control signal generator and to said receiver for carrying the control signal pulses from the control signal generator to the data ports and a serial block of data pulses from the respective input data ports to the receiver;

wherein each input data port includes a data register for registering an input data signal related to that input data port and for serially transferring the input data signal pulses related to that input data port from the data register onto the input data line during the second-state intervals of the pulsed clock signal, means for demultiplexing data signal pulses and control signal pulses received over the input data line from other input data ports and the control signal generator, and means for multiplexing all of the input data signal pulses and control signal pulses onto the input data line in their respective clock signal state intervals for transmission to the receiver and other input data ports connected in series between that input data port and the receiver.

2. A system according to claim 1, wherein each input data port includes an address circuit for determining when that port is enabled to transfer input data signals related to that port onto the input data line independent of that port's physical location on the input data line.

3. A system according to claim 2, wherein the control signals generated by the control signal generator include frame signals for indicating each beginning of a block of data pulses from the daisy chain of input data ports; and wherein the address circuit includes a frame signal detector connected to the data line for providing a reset signal to a clock pulse counter in response to each frame signal;

an address register for storing a preselected count that determines when the port is enabled to transfer data onto the input data line; and a clock pulse counter for counting clock pulses beginning with each reset signal and coupled to the address register for providing a transfer signal when said clock pulse count equals the stored preselected count;

wherein the data register is coupled to the clock pulse counter for transferring the input data signal related to that input data port onto the input data line when the transfer signal is provided by the clock pulse counter to thereby merge the related input data signal with input data signals transferred onto the input data line from the other input data ports.

4. A system according to claim 1, wherein the input data line enters and exits each data port;

wherein the demultiplexing means comprises a pair of flip-flops, each having their data inputs connected to the entering input data line, wherein one flip-flop is coupled to the clock line for regenerating the control signal pulses onto an internal control line during the first-state intervals of the clock signal and the other flip-flop is coupled to the clock line for regenerating the data signal pulses onto an internal data line during the second-state intervals of the clock signal;

wherein the input data signal related to that input data port is transferred from the data register onto the internal data line; and wherein the multiplexing means comprises a switch that is clocked by the clock signal for connecting the internal control line to the existing input data line during the first state intervals of the clock signal and for connecting the internal data line to the exiting input data line during the second-state intervals of the clock signal.

5. A system according to claim 1, wherein the clock signal generator changes the state of the clock signal slightly in advance of the respective beginnings of the control signal pulses and data signal pulses; and wherein the data register is responsive to the clock signal for transferring a said data signal pulse each time the clock signal changes from its first state to its second state.

6. A telemetry system for transferring pulsed output signals in series to a daisy chain of output data ports from a transmitter, said system comprising a daisy chain of output data ports;

a clock signal generator for generating a pulsed clock signal having periodically alternating first and second states;

a clock line connected to the output data ports for carrying the clock signal pulses from the clock signal generator to the output data ports for timing the operation of the data ports;

a control signal generator for generating control signal pulses during the first-rate intervals of the pulsed clock signal; and an output data line serially-connecting the output data ports to the control signal generator and to said transmitter for carrying the control signal pulses from the control signal generator to the data ports and a serial block of data pulses to the respective output data ports from the transmitter;

wherein each output data port includes a data register for registering output data signals and for serially transferring the output data signal pulses into the data register from the output data line during the second-state intervals of the pulsed clock signal; means for demultiplexing data signal pulses and control signal pulses received over the output data line from other output data ports, said transmitter and the control signal generator; and means for multiplexing all of the output data signal pulses and control signal pulses onto the output data line in their respective clock signal-state intervals for transmission to the other output data ports connected in series beyond that output data port with respect to the transmitter.

7. A system according to claim 6, wherein each output data port includes an address circuit for determining when that port is enabled to transfer output data signals related to that port from the output data line independent of that port's physical location on the output data line.

8. A system according to claim 7, wherein the control signals generated by the control signal generator include frame signals generated by the control signal generator include frame signals for indicating each beginning of a clock of data pulses transmitted to the daisy chain block of output data ports; and wherein the address circuit includes a frame signal detector connected to the data line for providing a reset signal to a clock pulse counter in repsonse to each frame signal;

an address register for storing a preselected count that determines when the port is enabled to transfer data from the output data lines;

a clock pulse counter for counting clock pulses beginning with each reset signal and ocupled to the address register for providing a transfer signal when said clock pulse count equals the stored preselected count; and a latch coupled to the clock pulse counter for transferring the output data signal related to that output data port from the data register when the transfer signal is provided by the clock pulse counter to thereby segregate the related output data signal from the other output data signals transferred over the output data line to the other output data ports.

9. A system according to claim 6, wherein the output data line enters and exits each data port;

wherein the demultiplexing means comprises a pair of flip-flops, each having their data inputs connected to the entering output data line, wherein one flip-flop is coupled to the clock line for regenerating the control signal pulses onto an internal control line during the first-state intervals of the clock signal and the other flip-flop is coupled to the clock line for regenerating the data signal pulses onto an internal data line during the second-state intervals of the clock signal;

wherein the output data signal related to that input data port is tranferred from the internal data line into the data register; and wherein the multiplexing means comprises a switch that is clocked by the clock signal for connecting the internal control line to the exiting output data line during the first state intervals of the clock signal and for connecting the internal data line to the exiting output data line during the second-state intevals of the clock signal.

10. A system according to claim 6, wherein the clock signal generator changes the state of the clock signal slightly in advance of the respective beginnings of the control signal pulses and data signal pulses; and wherein the data register is responsive to the clock signal for beginning the shift of data signal pulses when the clock signal changes from its first state to its second state.

11. A telemetry system for transferring pulsed input data signals in series from a daisy chain of input data ports to a receiver, and for transferring pulsed output data signals in series to a daisy chain of output data ports from a transmitter, said system comprising a daisy chain of input data ports;

a daisy chain of output data ports;

a clock signal generator for generating a pulsed clock signal having periodically alternating first and second states;

a clock line connected to the input data ports and the output data ports for carrying the clock signal pulses from the clock signal generator to the data ports for timing the operation of the data ports;

means for generating control signal pulses during the first-state intervals of the pulsed clock signal;

an input data line serially-connecting the input data ports to the control signal generator and to said receiver for carrying the control signal pulses from the control signal generator to the data ports and a serial block of data pulses from the respective input data ports to the receiver; and an output data line serially-connecting the output data ports to the control signal generator and to said transmitter for carrying the control signal pulses from the control signal generator to the data ports and a serial block of data pulses to the respective output data ports from the transmitter;

wherein each input data port includes a register for registering an input data signal related to that input data port and for serially transferring the input data signal pulses related to that input data port onto the input data line during the second-state intervals of the pulsed clock signal, means for demultiplexing data signal pulses and control signal pulses received over the input data line from other input data ports and the control signal generator, and means for multiplexing all of the input data signal pulses and control signla pulses onto the input data line in their respective clock signal-stae intervals for transmission to the receiver and other input data ports connected in series between that input data port and the receiver; and wherein each output data port includes a data register for registering output data signals and for serially transferring the output data signal pulses into the data register from the output data line during the second-state intervals of the pulsed clock signal; means for demultiplexing data signal pulses and control signal pulses received over the output data line from other output data ports, said transmitter and the control signal generator; and means for multiplexing all of the output data signal pulses and control signal pulses onto the output data lines in their respective clock signal-state intervals for transmission to the other output data ports connected in series beyond that output data port with respect to the transmitter.

12. A system according to claim 11, further comprising means for determining the serial location of a said data port where a failure has occurred.

13. A system according to claim 12, wherein the input data line and the output data line each serially connect the input data ports and the output data ports; and wherein the determining means comprise means for generating a predetermined test control signal during first-state intervals of the clock signal and for generating predetermined test data signals during immediately following second-state intervals of the clock signal, wherein said transmitter is coupled to the test signal generating means for transmitting said test control and test data signals over the output data line;

means in each data port for recognizing said test control signal and for responding to said recognition by transferring the immediately following test data signal from the output data line onto the input data line in substitution for said input data signal, whereby said test data signal is carried to said receiver;

means for comparing the data signal received by said receiver over the input data line with the test data signal; and a counter ocupled to the comparing means, the test signal generating means and the clock signal generator for counting clock signal pulses beginning upon the transmission of the test data signal and continuing until a data signal is received over the input line that is different than the test data signal that was transmitted over the output line to thereby obtain a count indicating the number of data ports removed from said transmitter at which a data port failed to accurately return the test data signal that was transmitted.

14. A system according to claim 11, wherein the input data line and the output data line each serially connect the input data ports and the output data ports, further comprising means for generating a predetermined test control signal during first-state intervals of the clock signal and for generating predetermined test data signals during immediately following second-state intervals of the clock signal, wherein said transmitter is coupled to the test signal generating means for transmitting said test control and test data signals over the output data line; and means in each data port for recognizing said test control signal and for responding to said recognition by transferring the immediately following test data signal from the output data line onto the input data line in substitution for said input data signal, whereby said test data signal is carried to said receiver;

whereby the serial location of a data terminal at which a failure has occurred may be determined by comparing the data signal received by said receiver over the input data line with the test data signal; and by counting clock signal pulses beginning upon the transmission of the test data signal and continuing until a data signal is received over the input line that is different than the test data signal that was transmitted over the output line to thereby obtain a count indicating the number of data ports removed from said transmitter at which a data port failed to accurately return the test data signal that was transmitted.

15. A telemetry system for transferring pulsed input data signals in series from a daisy chain input data ports to a receiver, and for transferring pulsed output data signals in series to a daisy chain of output data ports from a transmitter, said system comprising a daisy chain of input data ports;

a daisy chain of output data ports;

an input data line serially-connecting the input data ports to said receiver for carrying a serial block of data pulses from the respective input data ports to the receiver;

an output data line serially-connecting the output data ports to said transmitter for carrying a serial block of data pulses to the respective output data ports from the transmitter; and means for determining the serial location of a said data port where a failure has occurred.

16. A system according to claim 15, further comprising a clock signal generator for generating a pulsed clock signal and coupled to the data ports for clocking serial transfer of the data signals over the data lines;

wherein the input data line and the output data line each serially connect the input data ports and the output data ports; and wherein the determining means comprise means for generating a predetermined test control signal and for generating predetermined test data signals immediately following the test control signal, wherein said transmitter is coupled to the test signal generating means for transmitting said test control and test data signals over the output data line;

means in each data port for recognizing said test control signal and for responding to said recognition by transferring the immediately following test data signal from the output data line onto the input data line in substitution for said input data signal, whereby said test data signal is carried to said receiver;

means for comparing the data signal received by said receiver over the input data line with the test data signal; and a counter coupled to the comparing means, the test signal generating means and the clock signal generator for counting clock signal pulses beginning upon the transmission of the test data signal and continuing until a data signal is received over the input line that is different than the test data signal that was transmitted over the output line to thereby obtain a count indicating the number of data ports removed from said transmitter at which a data port failed to accurately return the test signal that was transmitted.

* * * * *